US008177476B2

(12) United States Patent
Andrew et al.

(10) Patent No.: US 8,177,476 B2
(45) Date of Patent: May 15, 2012

(54) METHOD AND APPARATUS FOR CLEARANCE CONTROL

(75) Inventors: Philip L. Andrew, Simpsonville, SC (US); James M. Fogarty, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 506 days.

(21) Appl. No.: 12/411,275

(22) Filed: Mar. 25, 2009

(65) Prior Publication Data

US 2010/0247283 A1 Sep. 30, 2010

(51) Int. Cl.
*F01D 11/14* (2006.01)

(52) U.S. Cl. ..... 415/1; 415/48; 415/131; 415/173.1; 415/173.2

(58) Field of Classification Search ..... 415/48, 415/131, 132, 173.1, 173.2
See application file for complete search history.

(56) References Cited

U.S. PATENT DOCUMENTS

| | | | | |
|---|---|---|---|---|
| 4,961,310 | A | 10/1990 | Moore et al. | |
| 5,263,816 | A * | 11/1993 | Weimer et al. | 415/131 |
| 5,312,226 | A * | 5/1994 | Miura et al. | 415/106 |
| 5,658,125 | A * | 8/1997 | Burns et al. | 415/1 |
| 6,273,671 | B1 * | 8/2001 | Ress, Jr. | 415/1 |
| 6,676,372 | B2 | 1/2004 | Scholz et al. | |
| 7,234,918 | B2 | 6/2007 | Brillert et al. | |
| 2009/0015012 | A1 * | 1/2009 | Metzler et al. | 290/52 |
| 2009/0297330 | A1 * | 12/2009 | Razzell et al. | 415/1 |
| 2010/0080691 | A1 * | 4/2010 | Davi et al. | 415/126 |

OTHER PUBLICATIONS

Maslen, E., et al.; "Design of Thrust Actuators"; 11 pages (undated).
Maslen, E., et al.; "Design of Radial Actuators"; 57 pages (undated).
Maslen, E.; "Magnetic Bearings"; University of Virginia, Department of Mechanical, Aerospace, and Nuclear Engineering; Charlottesville, Virginia; 245 pages (Revised Jun. 5, 2000).
http://en.wikipedia.org/wiki/Linear_actuator; 5 pages; (last viewed Nov. 6, 2008).
"Active Magnetic Bearings & PM Motors for industry"; Kingsbury, Inc., Magnetic Bearings Division, 31 pages (Nov. 2004).

* cited by examiner

*Primary Examiner* — Stephen W Smoot
(74) *Attorney, Agent, or Firm* — Fletcher Yoder P.C.

(57) ABSTRACT

A system, in certain embodiments, includes a magnetic actuator configured to adjust a radial clearance between a housing and rotary blades via translational movement along a rotational axis. The system includes a controller configured to engage the magnetic actuator to adjust the radial clearance in response to feedback.

20 Claims, 6 Drawing Sheets

METHOD AND APPARATUS FOR CLEARANCE CONTROL

BACKGROUND OF THE INVENTION

The subject matter disclosed herein relates to clearance control techniques, and more particularly to a system and method for adjusting the clearance between a stationary component and a rotary component of a rotary machine.

In certain applications, a clearance exists between components that move relative to one another. For example, a clearance may exist between rotary and stationary components in a rotary machine, such as a compressor, turbine, or the like. The clearance may increase or decrease during operation of the rotary machine due to temperature changes or other factors. In turbine engines, it is desirable from a performance and durability perspective to provide greater clearance during transient conditions, such as start-up, while providing lesser clearance during steady state conditions.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a turbine engine includes a turbine housing configured to guide a flow of combustion gases. The turbine engine also includes a plurality of blades coupled to a shaft inside the turbine housing. The turbine engine also includes a magnetic actuator coupled to the shaft and configured to magnetically translate the shaft along an axis of the shaft to increase and decrease a radial clearance between the turbine housing and the plurality of blades.

In a second embodiment, a system includes a magnetic actuator configured to adjust a radial clearance between a housing and rotary blades via translational movement along a rotational axis. The system also includes a controller configured to engage the magnetic actuator to adjust the radial clearance in response to feedback.

In third embodiment, a method of operating a turbine includes positioning a shaft of the turbine linearly toward a first position configured to increase a clearance between rotary components coupled to the shaft and a stationary housing surrounding the shaft, gradually increasing a rotational speed of the shaft, and magnetically translating the shaft toward a second position configured to decrease the clearance between the rotary components and the housing surrounding the shaft.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
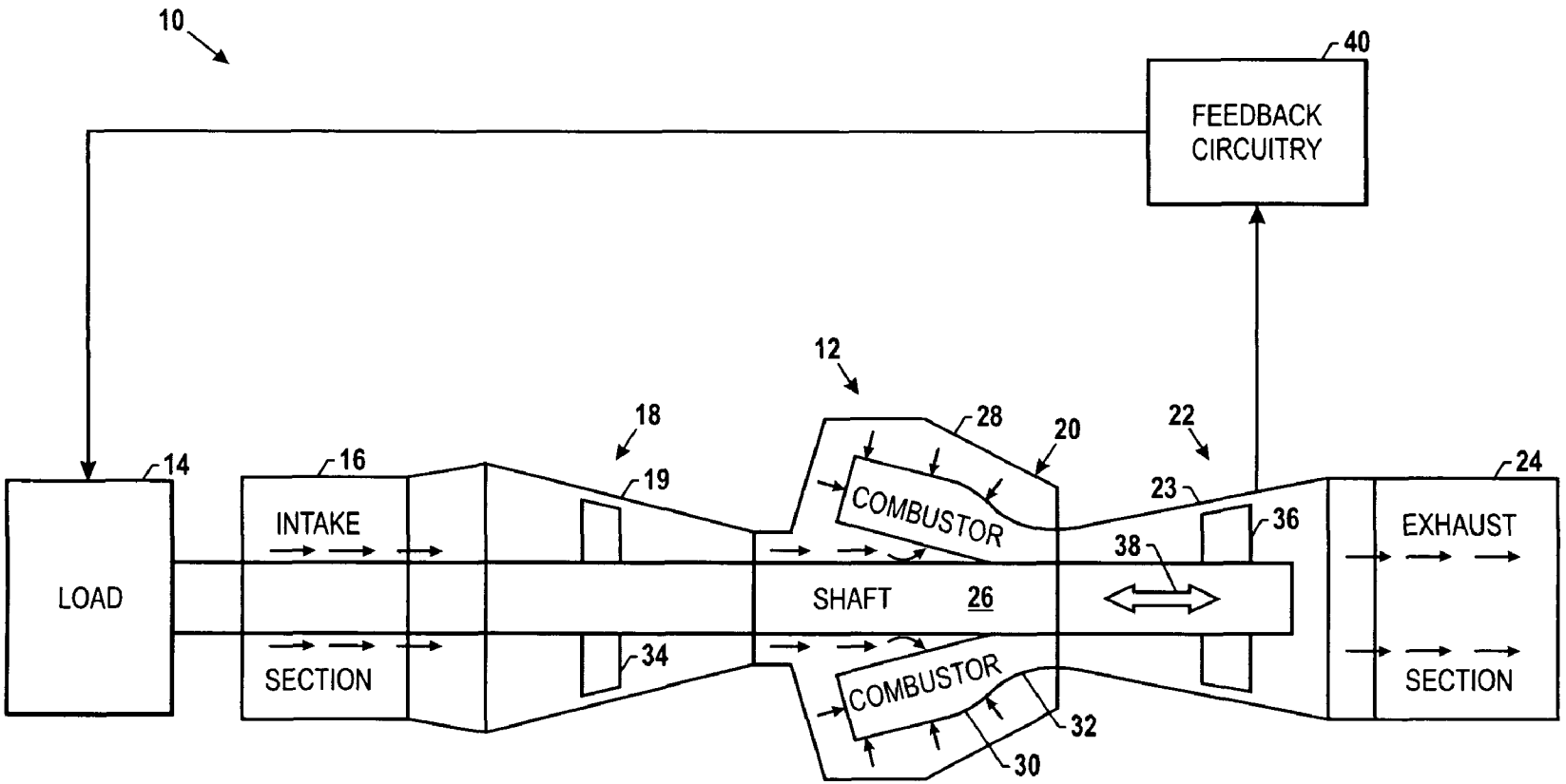
FIG. 1 is a diagram illustrating an embodiment of a system that includes a gas turbine with magnetically-actuated clearance control.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments include a magnetic actuator to control a clearance between components that move relative to one another. The clearance may correspond to an annular gap, a linear gap, a rectangular gap, or any other geometry depending on the system, type of movement, and other factors. For example, the clearance may correspond to a gap between a stationary housing and rotating blades of a compressor, a turbine, or the like. Thus, the clearance may control the amount of leakage or rub between the rotating blades and the housing. The leakage may correspond to any fluid, such as air, water, steam, hot gases of combustion, and so forth. The magnetic actuator may provide linear movement along a rotational axis of a rotary machine, such as a compressor or turbine. Specifically, embodiments disclosed herein provide techniques for linearly translating a shaft of a turbine to control the clearance. Additionally, the movement of the shaft may be controlled by the system load, such as the generator, and may also be controlled electrically, rather than hydraulically. This may simplify the turbine and provide improved reliability compared to existing techniques. Furthermore, in some embodiments, the translation of the shaft may occur gradually, depending on the operating conditions of the turbine, which may be measured by sensors, such as temperature sensors, vibration sensors, position sensors, clearance sensors, etc. By providing gradual adjustment of the shaft, the clearance may be finely adjusted to balance the turbine efficiency against the possibility of contact between the turbine blades and the turbine housing, according to operating conditions of the turbine at any given moment. However, certain embodiments may provide a simple two-stage or two-position clearance control with maximum and minimum clearances corresponding to engagement and disengagement of the magnetic actuator.

FIG. 1 is a block diagram of an exemplary system 10 that includes a gas turbine engine 12 having magnetically-actuated clearance control in accordance with embodiments of the present technique. The system 10 may include an aircraft, a watercraft, a locomotive, a power generation system, or combinations thereof. Accordingly, the turbine engine 12 may drive a variety of loads 14, such as a generator, a propeller, a transmission, a drive system, or combinations thereof. The illustrated gas turbine engine 12 includes an air intake section 16, a compressor 18, a combustor section 20, a turbine 22, and an exhaust section 24. The turbine 22 is drivingly coupled to the compressor 18 via a shaft 26.

As indicated by the arrows, air flows through the intake section 16 and into the compressor 18. The compressor 18 includes a compressor housing 19 that guides the intake air to the combustor section 20. Inside the compressor 18, blades 34 are coupled to the shaft 26 and span the radial gap between the shaft 26 and the inside wall of the compressor housing 19. The compressor blades 34 are separated from the inside wall of the compressor housing 19 by a small radial gap to avoid contact between the compressor blades 34 and the inside wall of the compressor housing 19. Rotation of the shaft 26 causes rotation of the compressor blades 34, drawing air into the compressor 18 and compressing the air prior to entry into the combustor section 20.

The illustrated combustor section 20 includes a combustor housing 28 disposed concentrically or annularly about the shaft 26 axially between the compressor 18 and the turbine 22. Inside the combustor housing 28, the combustor section 20 may include a plurality of combustors 30 disposed at multiple circumferential positions in a circular or annular configuration about the shaft 26. The compressed air from the compressor 18 enters each of the combustors 30, and then mixes and combusts with fuel within the respective combustors 30 to drive the turbine 22.

As indicated by the arrows, hot gases of combustion flowing out of the combustor 12 drive the turbine 22. The turbine 22 includes a turbine housing 23 that guides the combustion gases to the exhaust section 24. Inside the turbine 22, turbine blades 36 are coupled to the shaft 26 and span the radial gap between the shaft 26 and the inside wall of the turbine housing 23. The turbine blades 36 are separated from the inside wall of the turbine housing 23 by a small radial gap to avoid contact between the turbine blades 36 and the inside wall of the turbine housing 23. The combustion gases flowing through the turbine flow against and between the turbine blades 36 driving the turbine blades 36 and, thus, the shaft 26 into rotation. The shaft 26 rotation may be used for powering the compressor 18 and/or the load 14. In some embodiments, the exhaust may be used as a source of thrust for a vehicle such as a jet plane.

As will be described further below in reference to FIGS. 2 and 3, the radial clearance between the tip of the turbine blades 36 and the turbine housing 23 may be adjusted by moving the shaft 26 linearly along the axis of rotation of the shaft 26, as indicated by arrows 38. In some embodiments, this longitudinal or linear movement may be performed by the load 14 and may be performed electrically, e.g. magnetically. As such, some of the power delivered by the turbine 22 to the load 14 may be used to perform the linear translation of the shaft 26. Furthermore, the system 10 may also include a feedback circuitry 40 that measures a parameter of the turbine 22, such as temperature, vibration, noise, linear position, inlet guide vane (IGV) angle, or blade clearance. The feedback circuitry 40 may then relay a signal representative of the measured parameter back to the load 14 so that the load 14 may adjust the linear position of the shaft 26 accordingly. By adjusting the blade clearance in this way, more of the power created by the combustion of fuel in the combustor section 12 may be captured by the turbine 22.

Figure 2:
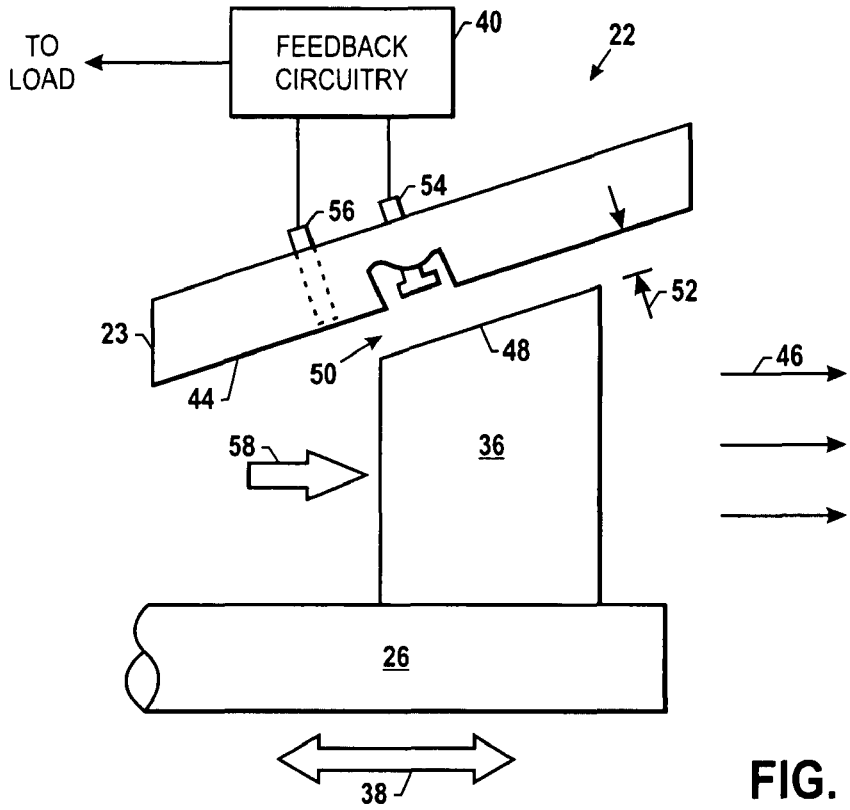
FIGS. 2 and 3 are partial cross-sections of the turbine of FIG. 1, illustrating embodiments of the clearance control techniques used in the turbine of FIG. 1.
Figure 3:
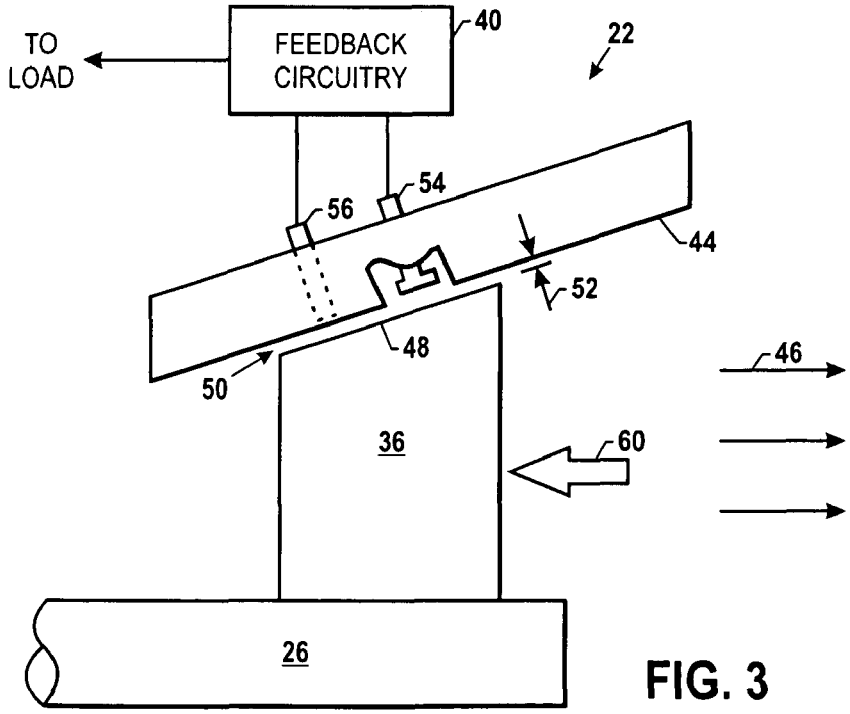
Figure 4:
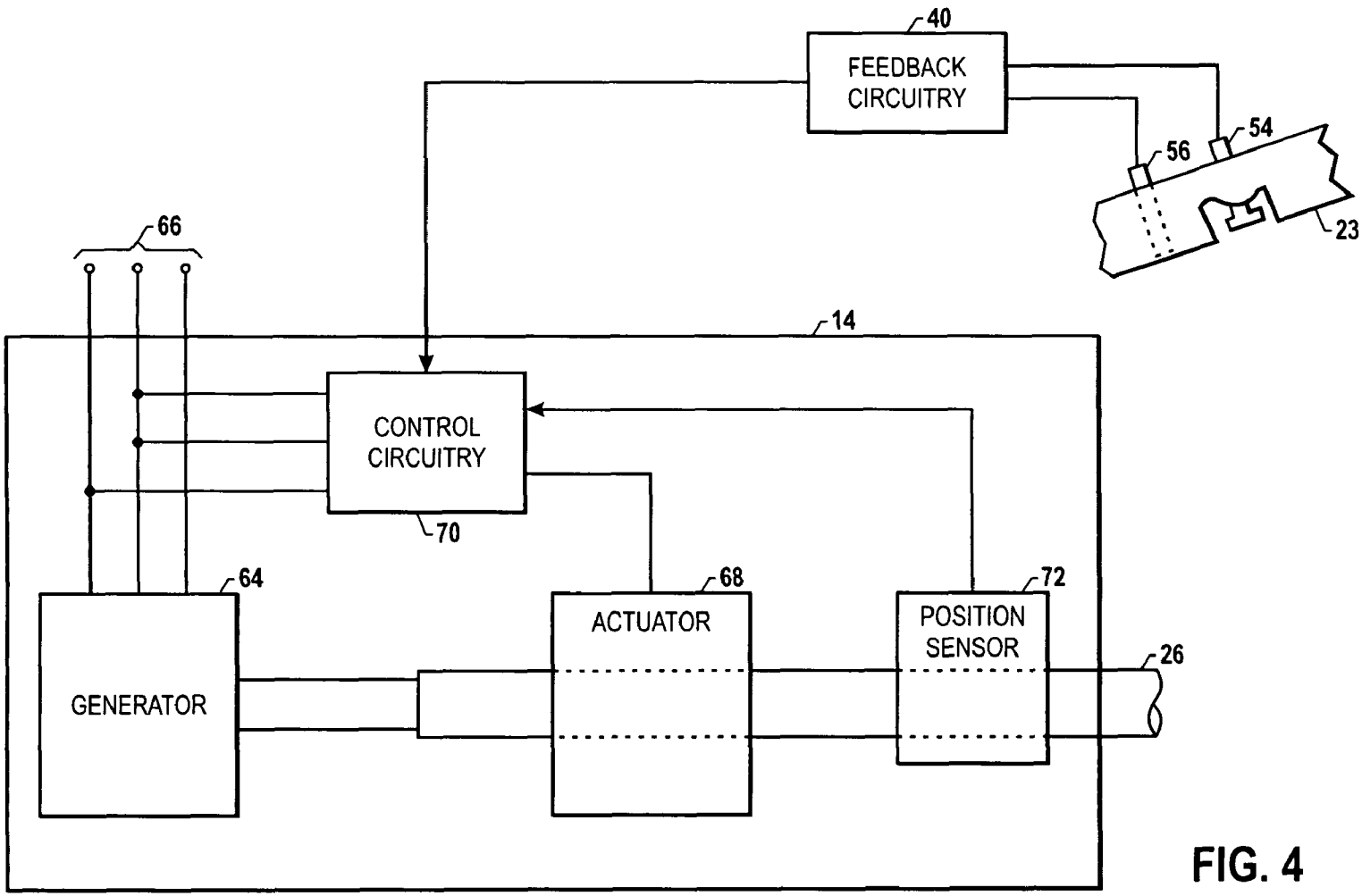
FIG. 4 is a diagram illustrating an embodiment of a load that controls the clearance adjustment of the turbine of FIG. 1.
Figure 5:
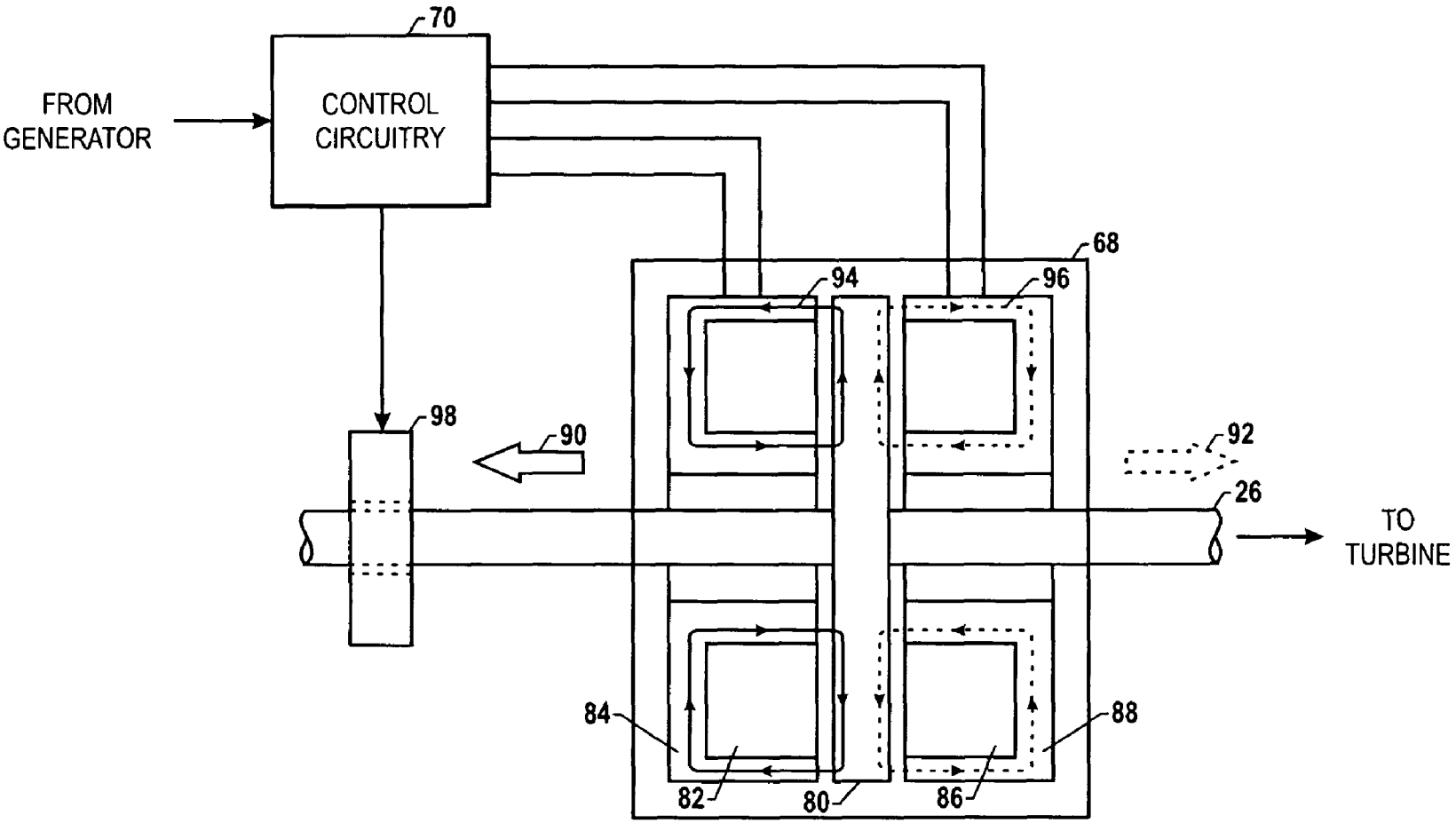
FIG. 5 is a diagram illustrating an embodiment of a linear actuator used to control the clearance adjustment in the turbine of FIG. 1.
Figure 6:
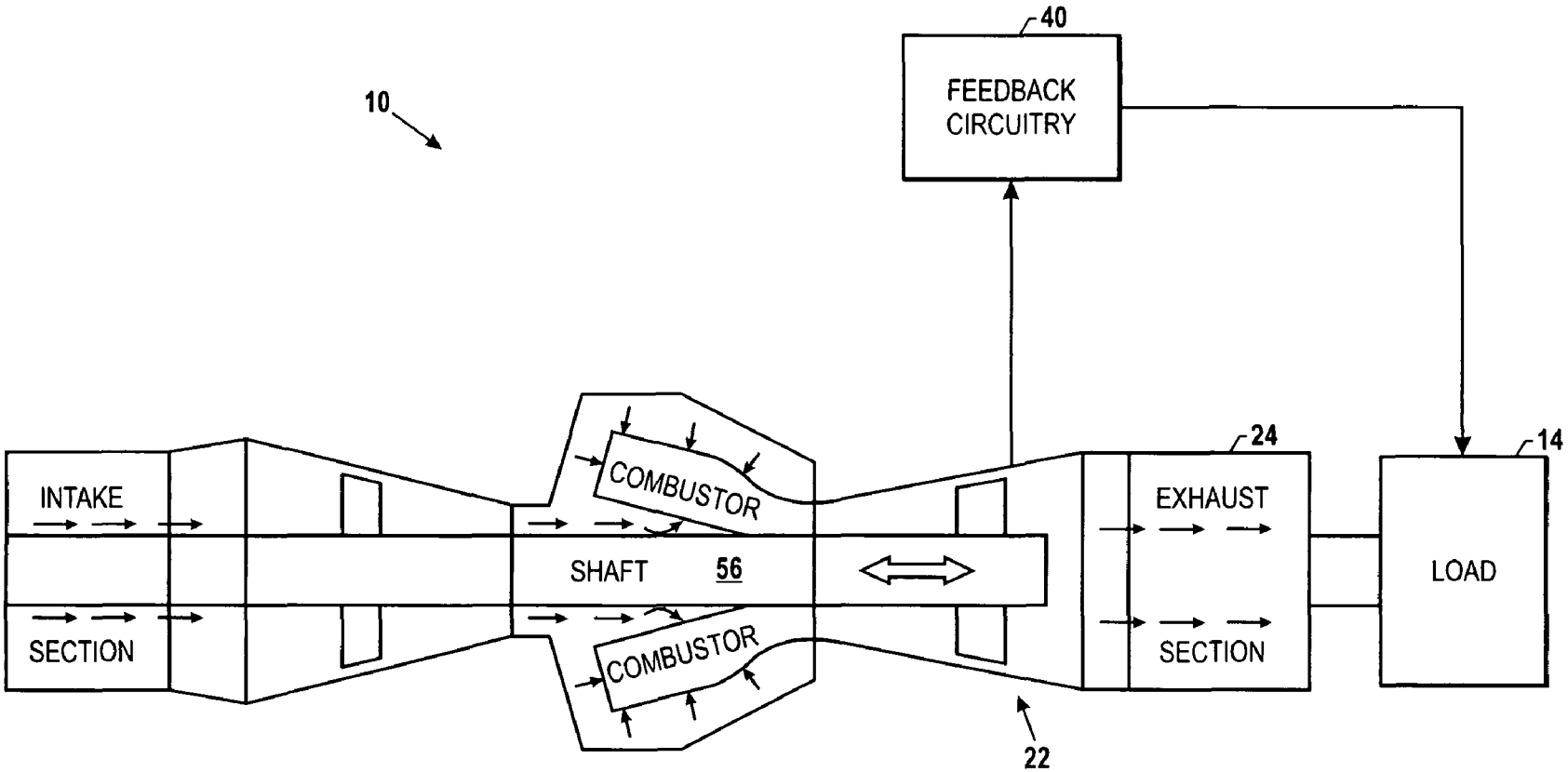
FIGS. 6 and 7 are diagrams illustrating additional embodiments of a system that includes a gas turbine with magnetically-actuated clearance control.
Figure 7:
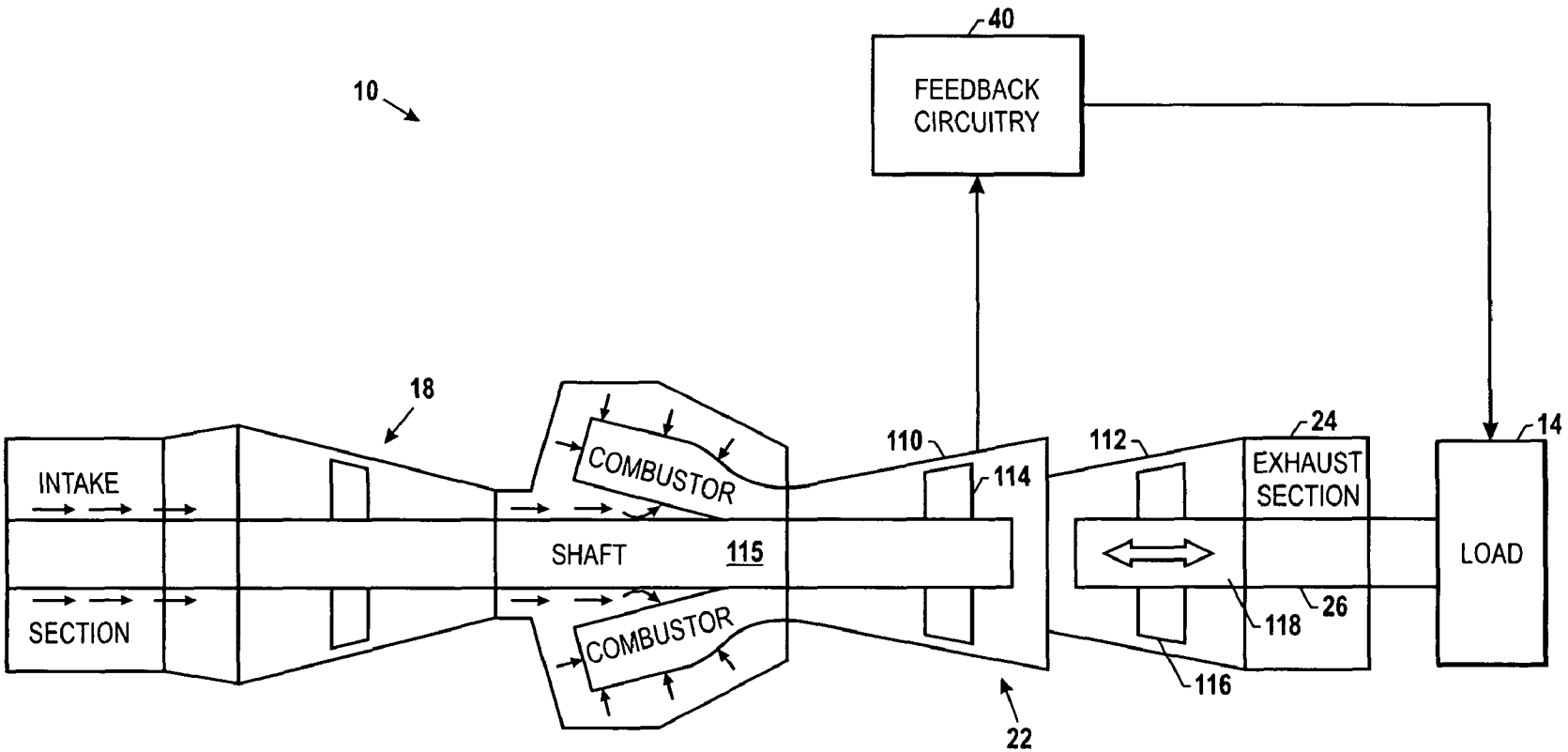

The clearance control techniques described herein may be better understood with reference to FIGS. 2 and 3, which illustrate the blade clearance adjustment of the turbine 22 through translation of the shaft 26. Techniques for actuating the shaft 26 and measuring the shaft 26 position are shown in FIGS. 4 and 5. Various other aspects and applications of the present techniques are shown in FIGS. 6 and 7.

FIGS. 2 and 3 are partial cross-sections of the turbine of FIG. 1, illustrating the clearance adjustment in the turbine of FIG. 1, in accordance with present techniques. As shown in FIG. 2, an inside surface 44 of the turbine housing 23 is conical and is, therefore, tapered outward, i.e. the diameter of the opening increases in the direction of the outward flow of combustion gases, represented by the arrows 46. Additionally, outer surfaces 48 of the blades 36 are also tapered to conform to the contour of the inside surface 44 of the turbine housing 23. As such, the a radial gap 50 (e.g., tapered annular or conical gap) between the inside surface 44 of the turbine housing 23 and the outer surface 48 of the blades 36 is relatively uniform over the outer surface 48 of the blade 36. The radial gap 50 prevents contact between the blades 36 and the housing 23. However, combustion gases flowing through the radial gap 50 do not contribute to the propulsion of the blades 36 and thus results in a loss of power to the shaft 26. Therefore, the narrower the radial gap distance 52, the more power may be generated by the turbine 22.

During start-up, differences in thermal expansion between the rotor structure and the stationary structure in the turbine 22 may tend to cause the radial gap distance 52 to decrease and potentially cause a rub condition. Therefore, the radial gap distance 52 may be increased during start-up to reduce the possibility of a rub. As the turbine heats due to the combustion gases from the combustor section 20, the blades 36 and rotor structure may tend to radially expand, causing the radial gap distance 52 to decrease. As the blades 36 radially expand, the radial gap distance 52 may be adjusted, as described below, to maintain the desired radial gap distance 52. As the turbine 22 and the blades 36 reach a thermal equilibrium, the radial gap distance 52 will tend to stabilize. Therefore, during stable operation of the turbine 22, the radial gap distance 52 may be kept relatively small to increase the efficiency of the turbine 22. As appreciated, rubs cause material property degradation that can result in durability issues via high-cycle fatigue. Also, a rub removes material from the blade tip and the stationary interface that increases the steady-state gap, for a performance penalty. Thus, it may be desirable to provide active clearance control to minimize the possibility of a rub condition during transient conditions, while maximizing performance during steady state conditions.

The turbine 22 may also include one or more sensors 54, 56 to monitor the operating conditions of the turbine 22. In some embodiments, the sensor 56 may monitor the temperature of turbine 22 and/or the vibration levels in the turbine 22. The signal from the sensor 56 may then be used to determine the desired radial gap distance 52, based on the vibrational stability or thermal stability of the turbine 22. As appreciated, a relationship between temperature and radial gap clearance 52 may be developed based on actual clearance measurements and temperature measurements, such that later temperature measurements can be used to determine clearance. In this way, a simple temperature measurement of the stationary part of the turbine 22 may be used to determine radial clearance 52, and thus act as a control parameter to trigger adjustments in the radial clearance 52. However, in some embodiments, the sensor 54 may be used to measure the actual radial gap distance 52. For example, the sensor 54 may measure the actual radial gap distance 52 by detecting a capacitance between the sensor 54 and the outer surface 48 of the blade. The difference between the desired radial gap distance 52 and the actual measured radial gap distance 52 may then be used to adjust the radial gap distance 52, as described below in reference to FIGS. 4 and 5, to maintain the desired radial gap distance 52. The radial gap distance 52 also may be controlled based on a set time, a set time after exceeding a threshold output level, or another operational parameter.

Signals from the sensors 54 and 56 may be sent to the feedback circuitry 40, which processes the sensor signals and sends a feedback signal to the load 14 representing the parameter(s) being measured, e.g. temperature, vibrations, actual radial gap distance 52, etc. As will be explained further below, the load 14 may then use the feedback signals to electrically adjust the radial gap distance 52. In this way, the radial gap distance 52 may be continuously adjusted throughout the operation of the turbine 22 to maintain a suitable balance between increasing the efficiency turbine 22 and decreasing the possibility of contact between the turbine blades 36 and the turbine housing 23.

As a result of the tapered shape of the turbine blade 36 and the turbine housing 23, the radial gap distance 52 may be adjusted by axially translating the shaft 26 forward and rearward, as indicated by the arrow 38. As will be described further below, the translation of the shaft 26 may be achieved using a magnetic actuator. For purposes of the present description, the term "forward" is used to describe the direction pointing inward toward the air inlet of the turbine 22, and the term "rearward" is used to describe the direction pointing outward toward the exhaust of the turbine 22. In other words, forward is in the upstream direction and rearward is in the downstream direction relative to the flow of the air and combustion gases. As shown in FIG. 2, the shaft 26 is positioned rearward, as indicated by the arrow 58. Positioning the shaft 26 rearward moves the blades 36 rearward and increases the radial gap distance 52 as shown, thus decreasing the possibility of a rub.

Turning briefly to FIG. 3, the shaft 26 is shown in a forward position, which moves the blades forward 36 as indicated by the arrow 60, thus reducing the radial gap distance 52, as shown in FIG. 2, and reducing the flow of combustion gases through the radial gap 50. Reducing the gas flow through the radial gap 50 increases the efficiency of the turbine 22 by causing the gas flow to preferentially flow against and through the blades 36 for driving the shaft 26 into rotation. It will be appreciated that the shaft 26 positions shown in FIGS. 2 and 3 represent only two possible shaft 26 positions and that the shaft may also be positioned anywhere in between the two locations shown, i.e., the desired radial gap distance 52 is not limited to discrete increments. In some embodiments, the gap width 52 may vary from approximately 1 to 3 mm in the rearward position to approximately 0.5 to 1.5 mm in the forward position. Furthermore, this change in the gap width 52 may be accomplished by translating the shaft approximately 1 to 5 mm. As appreciated, the actual values are proportional to the size (e.g., outside diameter) of the turbine.

Turning now to FIG. 4, a block diagram illustrating an embodiment of a load 14 that controls the clearance adjustment of the turbine 22 of FIG. 1, in accordance with present techniques. As shown in FIG. 4, the load 14 may include a generator 64. The generator 64 may be powered by the rotation of the shaft 26 and may generate an electrical output 66. In some embodiments, the electrical output 66 may be a three-phase alternating-current (AC). The output power 66 may be coupled to an electrical transmission network that provides electrical power to any suitable kind of electrical machinery.

The load 14 may also include an actuator 68, which translates the shaft 26 forward and rearward, as discussed above. The actuator 68 may include any suitable electrical, linear-positioning device. For example, the actuator 68 may include electric motors, solenoids, moving coil actuators, etc. In some embodiments, the actuator may include a magnetic thrust bearing capable of providing a variable magnetic force for moving the shaft 26, as will be discussed below in reference to FIG. 5. Additionally, as shown in FIG. 4, the actuator 68 may be powered by the generator 64. In this way, the system 10 may be simplified due to the fact that a second power source is not used to actuate the shaft 26. In alternative embodiments, however, the actuator 68 may also be powered by an external power source (not shown) that is external to the load 14. Furthermore, the actuator 68 may also be located anywhere along the shaft 26, including locations that are outside of the load 14.

The actuator 68 may be controlled by a control circuitry 70 that receives electrical energy from the output 66 of the generator 64. In this way, the mechanical energy received from the turbine 22 through rotation of the shaft 26 powers both the generator 64 and the control circuitry 70. In some embodiments, the output level of the generator 64 and may be used to inform the control circuitry 70 regarding an operating condition of the turbine 22. For example, a low voltage output 66 may generally indicate that the turbine 22 is in a start-up phase of operation, during which time a wide radial gap distance 52 may be desirable. In contrast, a high voltage output 66 may generally indicate that the turbine 22 is in a steady-state phase of operation, during which time a narrow radial gap distance 52 may be desirable. This information regarding the operating conditions of the turbine may then be used by the control circuitry 70 to determine, at least in part, a suitable linear position of the shaft 26. For example, in some embodiments, the linear position of the shaft 26 may be proportional to the output voltage of the generator 64.

The control circuitry 70 may also receive the one or more feedback signals from the feedback circuitry 40. As discussed above, the feedback signals may provide the control circuitry 70 with data representative of one or more parameters being measured by the sensors 54 and 56. For example, temperature data or vibration data from sensor 56 may be used by the control circuitry 70 to estimate a desired radial gap distance 52. For another example, the actual radial gap distance 52 measured by sensor 54 may be used by the control circuitry 70 to estimate a shaft position adjustment for bringing the actual measured radial gap distance 52 to the desired radial gap distance 52. The signals received by the control circuitry 70 from the feedback circuitry 40 may be analog or digital. Additionally, the control circuitry 70 may process the received signals according to firmware or software programmed into the control circuitry 70.

The control circuitry 70 may also receive one or more signals from a position sensor 72, indicating a linear position of the shaft 26. The position sensor 72 may be any kind of linear position sensor, such as an optical sensor or hall-effect sensor, for example. In some embodiments, the control circuitry 70 may include a programmable memory that contains information relating the linear position of the shaft 26 with the resulting radial gap distance 52. The position sensor 72 may send a shaft-position signal to the control circuitry 70, and this signal may be used, at least in part, to adjust the shaft 26 position to bring the measured radial gap distance 52 to the desired radial gap distance 52. In some embodiments, the relationship between the linear position of the shaft 26 and the resulting radial gap distance 52 may be based on empirical measurements used to calibrate the position sensor 72, which may be programmed into the memory of the control circuitry 70. In this way, the radial gap distance 52 may be estimated based solely, or in part, on the linear position of the shaft 26. In response to the data received from one or more of the position sensor 72 and the feedback circuitry 40 (e.g., sensors 54 and 56), the control circuitry 70 may send an electrical signal to the actuator 68 to adjust the linear position of the shaft 26. In some embodiments, one or more of the position sensor 72 or the sensors 54 and 56 may be eliminated. In some embodiments, two or more of the position sensor 72 and the sensors 54 and 56 may be used together to increase the reliability of the system 10.

During operation of the system 10, the actuator 68 may translate the shaft 26 forward or rearward based on the output voltage of the generator 64, the signals from the feedback circuitry 40, the signal from the position sensor 72, or some combination thereof. For example, in one embodiment, the actuator 68 may translate the shaft 26 forward in response to an increasing voltage output of the generator 64. Furthermore, the degree of translation may be proportional to the voltage output of the generator 64. In another embodiment, the actuator 68 may translate the shaft 26 rearward during start-up of the turbine engine 12 and forward during steady state operation of the turbine engine 12. Moreover, the shaft 26 may be translated gradually from the rearward position to the forward position as the turbine engine 12 approaches the steady state operating condition as indicated by the sensors 54 and 56 and/or the electrical output of the generator 64. For example, the shaft 26 may be translated gradually to the forward position as the turbine blades 36 approach thermal and/or vibrational stability, as indicated by the sensor 54. In another embodiment, the temperature of the rotary blades and/or the housing, as measured by sensor 54, may serve as an indication of the actual radial gap distance 52 based on known thermal expansion or contraction characteristics of the turbine blades 36 and the turbine housing 23. In this embodiment, the control circuitry 70 may be configured to translate the shaft 26 to maintain a desired radial gap distance 52 based, at least partially, on the temperature of the rotary blades 36 and/or the turbine housing 23.

In some embodiments, the combustion gases impinging on the turbine blades 36 may exert a rearward force on the shaft 26. Additionally, in embodiments wherein the shaft 26 is oriented vertically, gravity may also exert a rearward force on the shaft 26. Furthermore, in some embodiments, the system 10 may include a resilient device, such as a spring, that biases the shaft 26 in the rearward direction. Therefore, the actuator 68 may be configured to apply only a forward force on the shaft 26. In this way, the position of the shaft 26 may be controlled by balancing the forward force exerted by the actuator 68 against the rearward force exerted by the combustion gases, gravity, or the spring. In this way, the design of the actuator 68 may be simplified. Furthermore, this may also provide the advantage of a failsafe mechanism. In other words, if the actuator 68 unexpectedly loses power or otherwise stops functioning, the shaft 26 will automatically be translated to a rearward direction, which increases the radial gap distance 52 and reduces the possibility of contact between the turbine blades 36 and the turbine housing 23. In other embodiments, the actuator 68 may be configured to apply both a forward force and a rearward force on the shaft 26.

Turning now to FIG. 5, a diagram illustrating an embodiment of a linear actuator 68 is provided, in accordance with present techniques. Although FIG. 5 illustrates a particular orientation of components, the linear actuator 68 may be used in any suitable orientation or configuration within the scope of the disclosed embodiments. For example, the linear actuator 68 may be disposed on a cold end, a hot end, an intermediate position, or multiple positions along the turbine 22, the compressor 18, or any suitable location in the turbine engine 12. By further example, one of the linear actuators 68 may be associated with multiple independent shafts, e.g., a first linear actuator 68 may be used with a first turbine shaft in a first turbine stage, a second linear actuator 68 may be used with a second turbine shaft in a second turbine stage, a third linear actuator 68 may be used with a third turbine shaft in a third turbine stage, and so forth. In this manner, the system may provide independent control of clearance in the various turbine stages. The same concept may be used in different stages of the compressor 18.

As shown in FIG. 5, the linear actuator 68 may, in some embodiments, be a magnetic thrust bearing. As such, the linear actuator 68 may include a thrust disk 80 and a forward coil 82 held within a forward stator 84 and configured to translate the shaft 26 forward, as indicated by the arrow 90. In some embodiments, the linear actuator 68 may also include a rearward coil 86 held within a rearward stator 88 configured to translate the shaft 26 rearward, as indicated by the dashed arrow 92. For clarity, the coils 82, 86 and stators 84, 88 are shown in cross-section. The thrust disk 80 may be a circular disk that includes a ferromagnetic material, such as iron. Furthermore, the thrust disk 80 is fixed to the shaft 26 and rotates with the shaft 26 adjacent to the coil 82 or, in embodiments with two coils, between the coils 82 and 86. Each of the coils 82 and 86 may include a conductor that is wound multiple times about the shaft 26 and is configured to conduct a current that energizes the coil and produces a magnetic field in the vicinity of the thrust disk 80, as indicated by the field lines 94 and 96. The stators 84 and 88 may include a ferromagnetic material, such as iron, and may be configured to concentrate the magnetic field produced by the coils 82 and 86 in the vicinity of the thrust disk 80. In this embodiment, the system 10 may also include a magnetic radial bearing 98 configured to support the shaft 26. As such, the control circuitry 70 may send control signals to the magnetic radial bearing 98. The control signals from the control circuitry 70 generate magnetic fields within the magnetic radial bearing 98 that cause the shaft 26 to float freely within the magnetic radial bearing 98 without directly contacting the magnetic radial bearing 98. In certain embodiments, this free floating attributed to the magnetic radial bearing 98 may facilitate the axial translation by the linear actuator 68 (e.g., magnetic thrust bearing).

The control circuitry 70 may be electrically coupled to the coils 82 and 86 and configured to produce current in the coils 82 and 86 that generates the magnetic field. During translation of the shaft 26, the control circuitry 70 energizes the coils 82 and 86 so that the magnetic field generated by the coils 82 and 86 exerts a motive force on the thrust disk 80. For example, to translate the shaft 26 forward 90, the control circuitry 70 may send a current to the coil 82 that generates the magnetic field 94 that surrounds the coil 82 and penetrates the thrust disk 80. The magnetic field 94 exerts a motive force on the thrust disk 80 that pulls the thrust disk 80 forward 90, thus decreasing the gap distance 52 between the turbine blade 36 and the turbine housing 23 (see FIG. 2.) To maintain the position of the shaft 26, the control circuitry 70 may turn off the coil 82 or reduce the current in the coil 82 to a level that balances the forward motive force exerted by the coil 82 against the rearward motive force exerted by the combustion gases on the turbine blades 36 and/or the biasing mechanism, as discussed above in reference to FIG. 4.

To translate the shaft 26 rearward, as indicated by the dashed arrow 92, the control circuitry 70 may, in some embodiments, reduce the current in the coil 82 to a level that allows the rearward force exerted by the combustion gases or the spring to overcome the forward force exerted by the magnetic field 94, thus allowing the shaft 26 to translate rearward 92. In other embodiments, however, the actuator 68 may translate the shaft 26 rearward via the coil 86. To translate the shaft 26 rearward in this embodiment, the control circuitry 70 may send a current to the coil 86 that generates the magnetic field 96 that surrounds the coil 86 and penetrates the thrust disk 80. The magnetic field 96 exerts a motive force on the thrust disk 80 that pulls the thrust disk 80 rearward 92, thus increasing the gap distance 52 between the turbine blade 36 and the turbine housing 23 (see FIG. 2.)

In the embodiments, the current output from the control circuitry 70 to the actuator 68 may be proportional to the desired degree of shaft 26 translation. Furthermore, in some embodiments, the current output from the control circuitry 70 to the actuator 68 may increase as the electrical output 66 of the generator 64 increases, and may even be proportional to the electrical output 66 of the generator 64. In this way, the shaft 26 position may be dependent on the magnitude of the electrical output 66 of the generator 64. In this embodiment, the electrical output 66 of the generator 64 will be zero at a moment just before start-up. Therefore, the input current to the coil 82 of the actuator 68 will also be zero, and the shaft 26 may be in a rearward 92 position, causing the radial gap distance 52 to be relatively large. As the generator 64 starts to power-up, the output voltage of the generator 64 gradually increases and, thus, the current applied to the coil 82 also increases. The increase in the current applied to the coil 82 gradually translates the shaft 26 to a more forward position, thus decreasing the radial gap distance 52 and increasing the turbine 22 efficiency. In this way, the radial gap distance 52 gradually decreases from a large gap during start-up, to a progressively smaller gap as the turbine 22 approaches steady-state operating conditions. In some embodiments, the current to the coil 82 may not be perfectly proportional to the generator output 66. Rather, in addition to the generator output voltage, signals from the feedback circuitry 40 and/or the position sensor 72 may also be used to control the current output to the coil 82. In this way, factors such as the turbine blade temperature, measured position of the shaft 26, etc. may also be used to adjust the shaft 26 position.

It will be appreciated that the techniques disclosed above may be used in any suitable system wherein a clearance is maintained between components that move relative to one another, e.g., rotating and stationary components. For example, the techniques described above may be used in gas turbine engines, or steam turbine engines, or hydro turbines. Likewise, the disclosed techniques may be used in compressors, e.g., stand-alone compressors or multi-stage compressors. Turning now to FIGS. 6 and 7, various exemplary embodiments of the system 10 are shown, in accordance with embodiments of the present invention. As shown in FIG. 6, the techniques describe above may be implemented in a single-shaft, hot-end drive application. In this embodiment, unlike in the embodiment shown in FIG. 1, work is produced at the exhaust end of the turbine engine 12. As such, the shaft 26 passes through the turbine engine 12 and the exhaust section 24 and is coupled to the load 14. As discussed above, the load 14 may be configured to control the actuation of the shaft 26, in accordance with disclosed techniques.

As shown in FIG. 7, the techniques describe above may also be implemented in a multiple-shaft application. In this embodiment, as in FIG. 6, work is produced at the exhaust end of the turbine engine 12. However, in this embodiment, the system 10 may include multiple turbine stages or sections, e.g., a high pressure turbine 110 and a low pressure turbine 112. Combustion gases may pass through both turbine sections 110, 112. The high pressure turbine section 110 may include a first set of turbine blades 114 configured to provide power to the compressor 18 by rotating a first shaft 115 as the combustion gases pass through the high pressure turbine 110 and impinge upon the first set of blades 114. Furthermore, the first set of turbine blades 114 may be adjustable to increase or decrease the power delivered to the compressor 18. For example, the blade pitch of the first set of turbine blades 114 may be adjusted so that less work is applied by the combustion gases to the first shaft 115. Combustion gases then exit the high pressure turbine 110 and enter the low pressure turbine 112 to power the load 14. Accordingly, the low pressure turbine 112 includes a second set of turbine blades 116 coupled to a second shaft 118. In certain embodiments, power matching between the first and second turbine sections 110 and 112 may be accomplished by rotating a variable area turbine vane (VATN) upstream of turbine blades 116. As in the turbine 22 discussed above, the radial gap distance 52 (FIGS. 2 and 3) between the turbine blades 116 and the turbine housing will affect the efficiency of the low pressure turbine 112. Accordingly, the second shaft 118 may be translated by the load 14 to increases or decrease the radial gap distance 52, as discussed above.

Again, as mentioned above, system 10 may provide independent clearance control in the different turbine stages, different compressor stages, or both. For example, with independent shafts 115 and 118, the system 10 may magnetically translate each shaft 115 and 118 to independently control the radial gap distance 52 in the respective turbines 110 and 112. As appreciated, a separate magnetic actuator may be associated with each shaft 115 and 118 of the respective turbines 110 and 112. Likewise, a single controller or independent controllers may be used with these separate magnetic actuators.

From the foregoing description, it will be appreciated that several advantages may be obtained using the disclosed techniques. For example, by using the load to translate the shaft electrically the system may be simplified compared to hydraulic or other techniques. By further example, by translating the shaft electrically rather than hydraulically, the possibility of system failure due to a leak of hydraulic fluid may be eliminated. Furthermore, due to the fact that translation of the shaft may occur gradually, the clearance may be finely adjusted to provide a suitable balance between the turbine efficiency and the possibility of contact between the turbine blades and the turbine housing. The disclosed electrical/magnetic clearance control systems are generally clean and low maintenance, while increasing the life and performance of the turbine. The disclosed electrical/magnetic clearance control systems may be described as non-fluid driven or fluid free, while also eliminating or reducing wear surfaces between moving parts (e.g., piston cylinder of hydraulic system). Technical effects of the invention include adjusting a clearance between a turbine housing and turbine blades rotating within the housing according to measured operating characteristics of the turbine.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbine engine, comprising:

a turbine housing configured to guide a flow of combustion gases;

a plurality of blades coupled to a shaft inside the turbine housing; and a magnetic actuator coupled to the shaft and configured to magnetically translate the shaft along an axis of the shaft to increase and decrease a radial clearance between the turbine housing and the plurality of blades.

2. The turbine engine of claim 1, wherein an inner surface of the turbine housing is tapered outwardly in a direction of the flow of combustion gases, and the plurality of blades comprise tapered surfaces that are offset from the inner surface of the turbine housing.

3. The turbine engine of claim 1, wherein the magnetic actuator comprises a magnetic thrust bearing.

4. The turbine engine of claim 1, comprising control circuitry electrically coupled to an input of the magnetic actuator and configured to send electrical signals to the magnetic actuator to translate the shaft in response to feedback associated with the radial clearance.

5. The turbine engine of claim 4, comprising an electrical generator having an output coupled to another input of the control circuitry, wherein the electrical signals sent from the control circuitry to the magnetic actuator are at least partially based on an output power of the electrical generator, and the magnetic actuator changes the radial clearance in response to changes in the output power.

6. The turbine engine of claim 4, comprising a clearance sensor configured to measure a width of the radial clearance between each of the plurality of blades and the turbine housing and send a corresponding clearance signal to the control circuitry as the feedback.

7. The turbine engine of claim 4, comprising a temperature sensor configured to measure a temperature of at least one of the turbine housing and the plurality of blades and send a corresponding clearance signal to the control circuitry as the feedback.

8. A system, comprising:

a magnetic actuator configured to adjust a radial clearance between a housing and rotary blades via translational movement along a rotational axis; and a controller configured to engage the magnetic actuator to adjust the radial clearance in response to feedback.

9. The system of claim 8, wherein the magnetic actuator is configured to translate the rotary blades linearly along the rotational axis to adjust the radial clearance between surfaces of the housing and the rotary blades.

10. The system of claim 8, comprising a position sensor configured to detect a linear position of the rotary blades along the rotational axis.

11. The system of claim 8, wherein the magnetic actuator is configured to gradually adjust the radial clearance via the translational movement based on the feedback representative of steady state and non-steady state conditions.

12. The system of claim 11, wherein the controller is configured to engage the magnetic actuator to increase the radial clearance during non-steady state conditions and decrease the radial clearance during steady state conditions.

13. The system of claim 8, comprising a temperature sensor configured to detect a temperature of at least one of the housing and the rotary blades as an indication of the radial clearance based on thermal expansion or contraction, and the controller is configured to engage the magnetic actuator at least partially based on the temperature as feedback.

14. The system of claim 8, comprising a gas turbine or a steam turbine having the housing and rotary blades.

15. A method of operating a turbine, comprising:

positioning a shaft of the turbine linearly toward a first position configured to increase a clearance between rotary components coupled to the shaft and a stationary housing surrounding the shaft;

gradually increasing a rotational speed of the shaft; and magnetically translating the shaft toward a second position configured to decrease the clearance between the rotary components and the housing surrounding the shaft.

16. The method of claim 15, comprising detecting a temperature of the turbine and determining the second position based on the temperature.

17. The method of claim 15, wherein magnetically translating the shaft toward the second position comprises sending a control signal to a magnetic thrust bearing magnetically coupled to the shaft.

18. The method of claim 17, wherein the shaft is coupled to an electric generator having an output power, and magnetically translating the shaft comprises moving the shaft an axial distance at least partially based on the output power.

19. The method of claim 15, comprising magnetically translating the shaft toward the first position to increase the clearance during non-steady state conditions, wherein magnetically translating the shaft toward the second position decreases the clearance during steady-state conditions.

20. The method of claim 15, comprising biasing the shaft toward the first position, wherein magnetically translating the shaft toward the second position comprises increasing a magnetic force to overcome the biasing.

* * * * *